US006929342B2

(12) United States Patent
Claramunt et al.

(10) Patent No.: US 6,929,342 B2
(45) Date of Patent: Aug. 16, 2005

(54) MEDIA-POSITION SENSOR SYSTEM

(75) Inventors: David Claramunt, Sant Esteve Sesrovires (ES); Carles Flotats, Barcelona (ES); Jose M Rio Doval, Sant Cugat del Valles (ES); Rodrigo Ruiz, Terrassa (ES); Marc Jansa, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 117 days.

(21) Appl. No.: 10/629,639

(22) Filed: Jul. 30, 2003

(65) Prior Publication Data

US 2005/0024415 A1 Feb. 3, 2005

(51) Int. Cl.[7] ..... B41J 29/38
(52) U.S. Cl. ..... 347/16

(58) Field of Search ..... 347/101, 107, 347/19, 16, 106

(56) References Cited

U.S. PATENT DOCUMENTS 6,412,907 B1 * 7/2002 Castelli et al. ..... 347/37
6,607,458 B2 * 8/2003 Downing et al. ..... 474/102

* cited by examiner

*Primary Examiner*—Thinh Nguyen
(74) *Attorney, Agent, or Firm*—Foley & Lardner LLP

(57) ABSTRACT

A sensor system for detecting skew in print media along the feed path of a hardcopy device is disclosed. In one embodiment of the invention the system is arranged to generate a first image of a area of print media at a first position along the feed path and to generate a second image of the area of print media at a second position along the feed path, the system is arranged to compare the first and second images and thereby detect a change in the angle of skew of the media between the first and second positions.

29 Claims, 5 Drawing Sheets

MEDIA-POSITION SENSOR SYSTEM

BACKGROUND

Image-forming devices are frequently used to form images on media, such as paper and other types of media. Image-forming devices include laser printers, inkjet printers, and other types of printers and other types of image-forming devices. Media is commonly moved through an image-forming device as the device forms the image on the media. The image-forming mechanism of the device, such as an inkjet printing mechanism, may move in a direction perpendicular to that in which the media moves through the image-forming device. Alternatively, the image-forming mechanism may remain in place while the media moves past it.

For high-quality image formation, the movement of the media through an image-forming device is desirably precisely controlled. If the media moves more than intended, there may be gaps in the resulting image formed on the media, whereas if the media moves less than intended, there may be areas of overlap in the resulting image. A media-advance sensor can be used to measure media advancement. However, high-quality media-advance sensors can be expensive, rendering their inclusion in lower-cost and mid-cost image-forming devices prohibitive. Less accurate and less costly sensors may be used, but they may provide less than desired sensing capabilities.

SUMMARY OF THE INVENTION

According to one aspect of the invention, there is provided a media feed measurement system adapted to identify media features at first and second locations spaced apart by a first distance along a media feed path, the system being arranged during a feed operation to identify a first then a second feature at the first location and subsequently to identify those features at the second location, the features being spaced apart along the feed path by a second distance substantially less than the first distance, the system being arranged to determine a given media feed distance in dependence upon the first and the second distance. The present invention also extends hardcopy devices, such as inkjet printers arranged to implement the invention and to the corresponding methods. Furthermore, the present invention also extends to computer programs, arranged to implement the methods of the present invention.

Further aspects of the invention will be apparent form the appended claims.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1A:
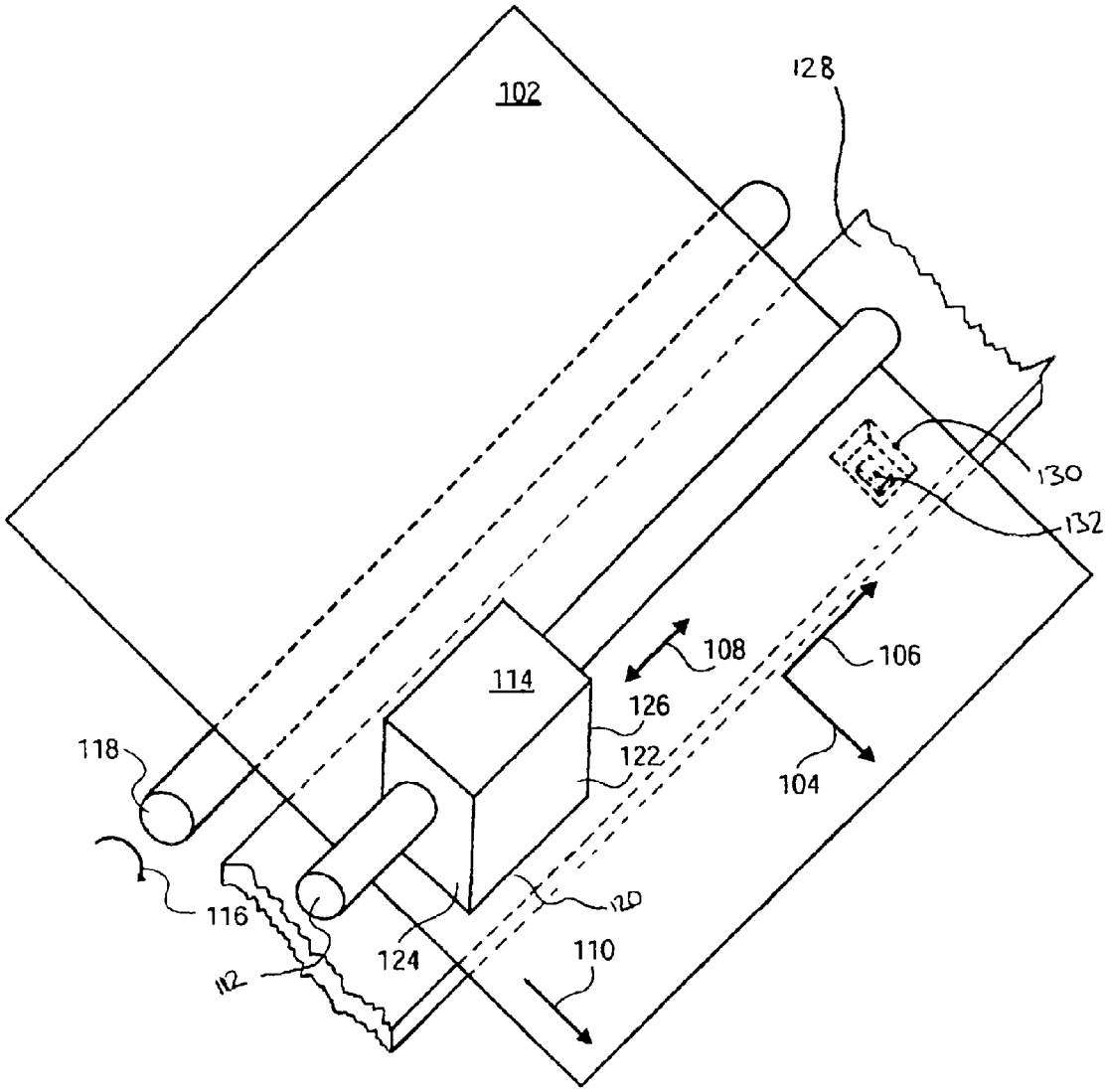
FIG. 1*a* is a schematic, perspective view of an image-forming device, according to an embodiment of the invention.

FIG. 1*a* shows a perspective view of an image-forming device, according to an embodiment of the invention. The device includes a shaft 112 on which a mechanism, or scanning carriage, 114 is slidably situated. The mechanism 114 has a left side 124, a right side 126, a front 122, and a bottom 120. The mechanism supports one or more printing heads (not shown); in the present embodiment these are conventional inkjet printheads. The mechanism 114 is able to move back and forth along a scanning axis 106, as indicated by the bi-directional arrow 108. As the mechanism moves back and forth, the printheads may be controlled to eject ink on print media located beneath the mechanism 114. The media 102 is advanced by a roller 118, which rotates in the direction indicated by the arrow 116. This causes the media 102 to move along a media axis 104 that is perpendicular to the scanning axis 106, as indicated by the arrow 110.

As can be seen from the figure, the media 102 is supported by a print platen 128 in the region where the media receives ink from the printheads. The print platen 128 has an opening 130 passing through its thickness. Also illustrated in the figure is a media-positioning sensor 132 according to the present embodiment. The media-positioning sensor 132 is located such that it is able to sense or image the underside of the media 102, which is resting on top of the platen 128, through the opening 130 in the platen. In practise, the media-positioning sensor 132 may be located in any convenient location; for example: in a recess in the upper surface of the platen; or, above the platen and the print media. In any event, however, it is preferable that the media-positioning sensor 132 does not obstruct the advance of the media. The sensor 132 may be an optical sensor, such as a charge-coupled device (CCD) sensor, a complementary metal-oxide semiconductor (CMOS) sensor, or another type of optical sensor.

When the media 102 is advanced by the roller 118 along the media axis 104, the sensor 132 is able to detect the changes in the position of the media 102 relative to its fixed position, as is described in more detail below.

Figure 1B:
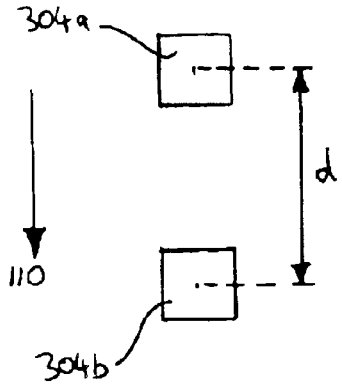
FIG. 1*b* is an enlarged view of the media-positioning sensor shown in FIG. 1*a*.

FIG. 1*b* shows an enlarged schematic view of the media-positioning sensor 132 shown in FIG. 1*a*. As can be seen from the figure, the sensor 132 comprises two individual sensing elements 304*a* and 304*b*. The sensing elements 304*a* and 304*b* are aligned with each other in the direction of the media advance direction 110. The centres of the sensing elements 304*a* and 304*b* are separated from each other in the media advance direction 110 by a separation distance "d". The two sensing elements 304*a* and 304*b* may be identical in the present embodiment and both are suitably located relative to the print medium such that they may image its surface. The sensing elements 304*a* and 304*b* are located in this manner using a conventional fixture (not shown). It will thus be appreciated that as the media is advanced, an area of print media that is aligned with the sensor 132 will pass first over the sensing element 304*a* and then over the sensing elements 304*b*.

Figure 2:
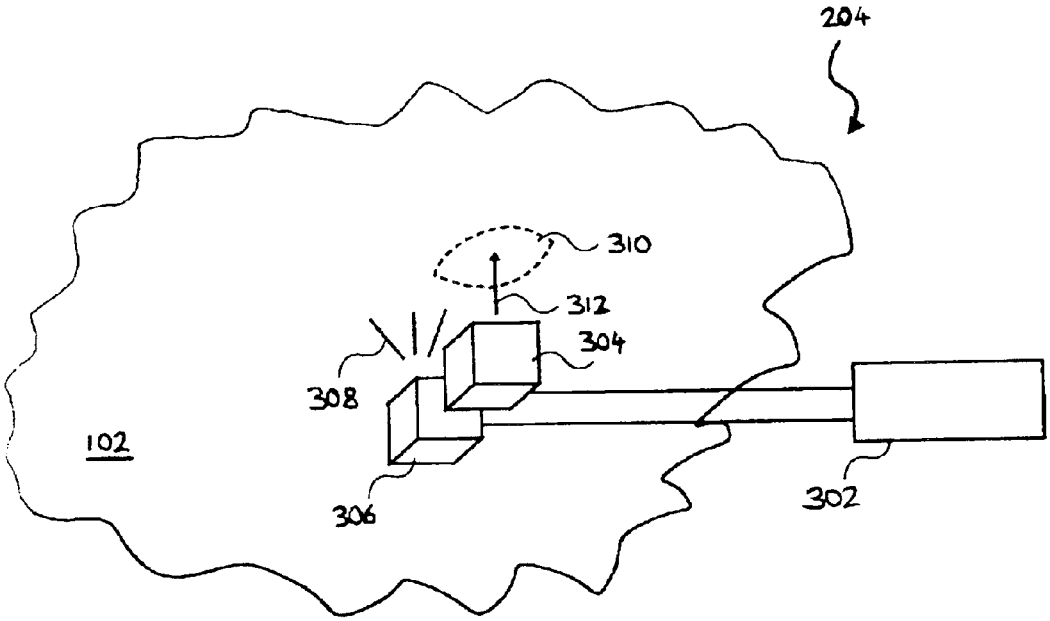
FIG. 2 is a schematic, perspective view of a media-positioning sensing element, according to an embodiment of the invention.

FIG. 2 schematically illustrates one of the sensing elements 304 in more detail. Associated with the sensing element 304 is an illumination mechanism 306, such as a light-emitting diode (LED). The sensing element 304 captures an image of a portion 310 of the media 102 that lies above it, as indicated by the arrow 312. For the sake of clarity, the platen 128 is not illustrated in this figure. The illuminating mechanism 306 illuminates the portion 310 of the media 102, as is indicated by the rays 308, so that the element 304 is able to capture a satisfactory image. The controller 302, which is more generally a controlling mechanism, may be software, hardware, or a combination of software and hardware. The controller 302 controls the element 304 and mechanism 306 so that images are captured and media portions are illuminated at desired times. The images captured may be of inherent physical aspects of the media 102, which are utilized to determine the positioning of the media 102. Such physical aspects of the media may include small scale (e.g. microscopic) features in the surface of the media. These may include fibres or characteristics caused by the process used to manufacture the media, for example.

In practice each of the sensing elements 304*a* and 304*b* may have a dedicated illumination mechanism 306 or a single illumination mechanism 306 may suffice for both of the sensing elements 304*a* and 304*b*. Additionally, both of the sensing elements 304*a* and 304*b* and the/both illumination mechanisms 306 may be connected to and controlled by the same controller 302.

One example of a sensing element suitable for use in embodiments of the present invention is described in U.S. Pat. No. 6,118,132 by Barclay, J. Tullis entitled, "System for Measuring the Velocity, Displacement and Strain on a Moving Surface or Web of Material" assigned to the assignee of the present invention and is herein incorporated by reference in its entirety.

In this manner, a portion of print media may be imaged by the sensor the sensing element 304*a* and then by the sensing elements 304*b*. Conventional artificial imaging or vision techniques may then be used to identify the positions of features of the media that are common to the images made by the sensing elements 304*a* and 304*b*. Since the separation of the two sensing elements 304*a* and 304*b* is known, the distance that the features have moved may be determined, in a conventional manner.

Figure 3:
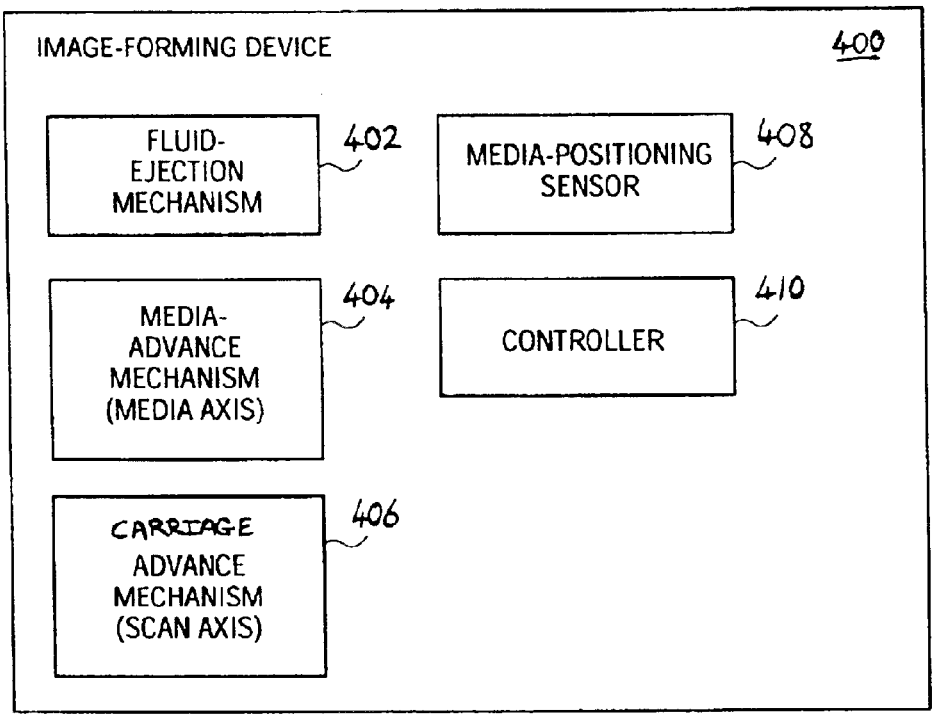
FIG. 3 is a block diagram of an image-forming device, according to an embodiment of the invention.

FIG. 3 shows a block diagram of an image-forming device 400, according to an embodiment of the invention. As can be appreciated by those of ordinary skill within the art, the image-forming device 400 may include components in addition to and/or in lieu of those depicted in FIG. 3. The image-forming device 400 may be a fluid-ejection device, such as an inkjet printer, or another type of image-forming device. The image-forming device 400 specifically is depicted in FIG. 3 as including a fluid-ejection mechanism 402, a media-advance mechanism 404, a carriage-advance mechanism 406, a media-positioning sensor 408, and a controller 410.

The fluid-ejection mechanism 402 moves back and forth along a first axis, over print media. The fluid-ejection mechanism 402 may eject fluid (such as ink) on the media during some such passes over the medium; for example, every other pass. Alternatively, it may eject fluid on the media during every pass over the medium. The media-advance mechanism 404 operates to advance the media along the media axis; which in this embodiment is a second axis perpendicular to the first axis. This may be during carrying out a print job. Depending upon the print mode used, this may be after every pass made by the mechanism over the media. Alternatively, this may be after two or more passes made by the mechanism over the media. Additionally, the media-advance mechanism 404 may advance the media before starting a print job or after completing a print job. Such media advances may be employed to correctly position the media to receive ink corresponding to a print job and then to transport the finished print job from the print zone, respectively. Such media advances are often of greater distance than those employed during a print operation. The media-advance mechanism 404 may include, for instance, the roller 118 of FIG. 1*a*. The carriage-advance mechanism 406 advances the carriage along the scan axis, which is the first axis. The mechanism 306 may include, for instance, the shaft 112 of FIG. 1*a*. In the present embodiment, the media-positioning sensor 408 may be the same as the media-positioning sensor 132 described with reference FIG. 1. The media-positioning sensor 408 is mounted stationary beneath the level of a media supporting surface or platen of the image-forming device 400. In this way, its component sensing elements are able to image the media supported thereon, as has been described in relation to FIG. 1*a*, FIG. 1*b* and FIG. 2. The sensor 408, which may utilise optical sensor elements, detects positioning of the media relative to the fixed position of the sensor 408. The controller 410 may be a combination of hardware and/or software, and controls operation of the fluid-ejection mechanism 402, the media-advance mechanism 404, the carriage-advance mechanism 406, and, the media-positioning sensor 408.

Figure 4:
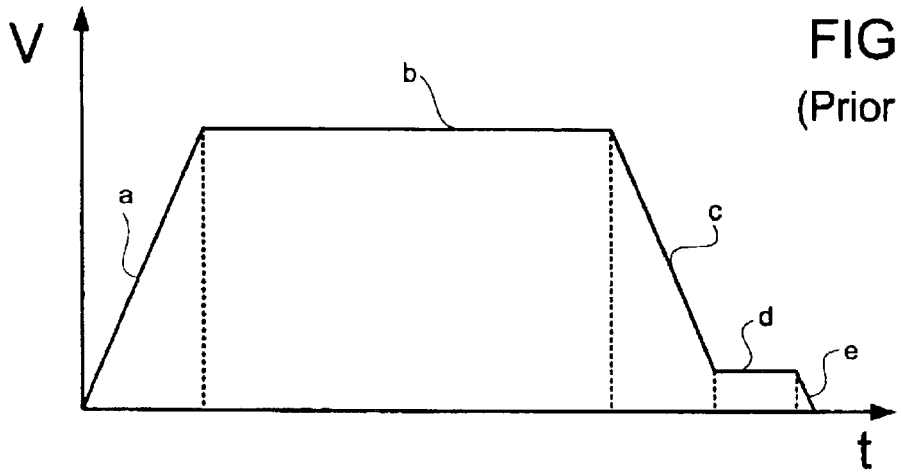
FIG. 4 (Prior Art)
FIG. 4 is a schematic diagram illustrating an idealised velocity profile for a media feed operation that may be employed in one embodiment of the present invention.

FIG. 4 illustrates a typical idealised velocity profile for a media feed operation which may be employed in one embodiment of the present invention. It will be appreciated that different print modes will require that the media is fed a different distance. However, a generalised velocity profile, such as is illustrated in FIG. 4, may be used for any given media feed distance. As can be seen from the figure, the figure gives the relationship between media feed velocity (Y axis) and time (X axis) for a given media feed. The profile is made up of five phases: firstly, the acceleration phase, referenced "a", in which the print media is accelerated from zero velocity to a selected "feed velocity"; secondly, the constant velocity phase referenced "b", during which the media is fed at the "feed velocity"; thirdly, the deceleration phase referenced "c", in which the print media is decelerated from the "feed velocity" to a "low velocity"; fourthly, the low velocity final phase referenced "d"; and, lastly, the final deceleration phase referenced "e", in which the print media is decelerated from the "low velocity" to a velocity of zero. During the phase "d", the media may be advanced comparatively slowly over a short distance, at the end of which, the media may be stopped comparatively accurately at a desired position, in the final deceleration phase "e". It will be understood, however, that the characteristics of the image-forming device will cause the actual velocity profile for any given media feed operation to differ slightly from the corresponding idealised profile. Because of such differences, small errors have historically been experienced in such printers, such as inkjet printers, which employ such velocity profiles in media feed operation.

Figure 5A:
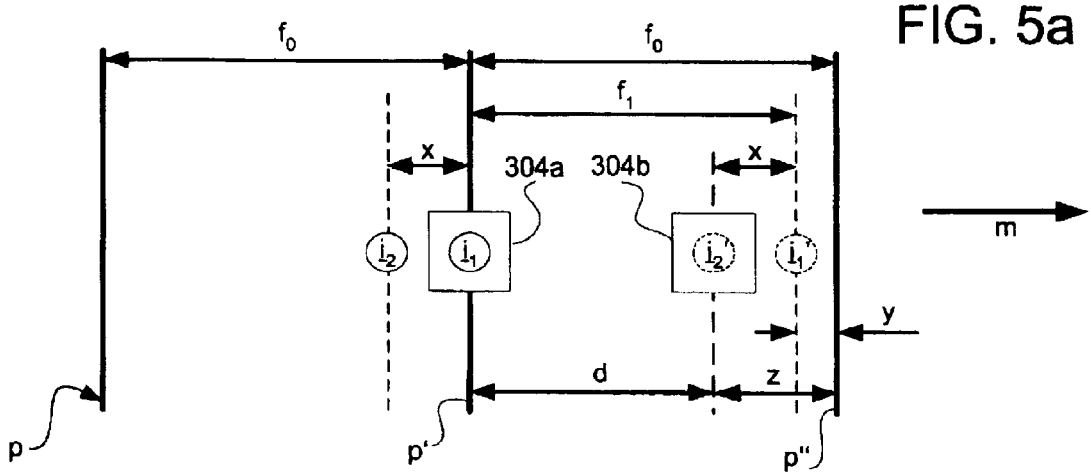
FIGS. 5*a–c* are diagrams illustrating the processes of measuring media movement during media feed operations according to embodiments of the invention.

FIG. 5*a* illustrates in a schematic manner the operation of a method according to an embodiment of the invention. In the figure, the sensing elements 304*a* and 304*b* are illustrated. They are separated in the media feed direction (indicated by the arrow "m") by a distance "d". Also shown in the figure are lines p, p', and p". The line p represents a line or border on the print media, lying perpendicular to the media feed direction. This border may be imaginary for the purpose of explanation only. Alternatively, it may represent the position on the print media on which part of a swath of ink is, or is to be printed by the image-forming device. Once the media has been fed one media feed distance, or a distance $f_0$ downstream, the new position of the border p is indicated by the line p'. By "downstream", a movement in the direction of a media input position to a media output position of the printer is meant; alternatively, this may be viewed as being in the direction from the print zone towards the output position of a printed sheet. Conversely, the term "upstream" will be understood as the reverse direction; i.e. a movement in the direction of a media output position of the printer towards a media input position. As can be seen from the figure, the line p' lies centrally, in the media feed direction, relative to the sensing element 304*a*. After the media has been fed a further media feed distance, or a further distance $f_0$ downstream, the new position of the border p is indicated by the line p" Thus, the line p" lies a distance of $f_0$ downstream from the sensing element 304*a* and a distance of "z" downstream from the sensing element 304*b*. It will be understood that each media feed advance or feed of distance $f_0$ may follow a velocity profile such as that illustrated in FIG. 4.

A media feed process of the present embodiment will now be described from the time that the border p has reached the line p' In this position, the sensing element 304*a* images the area of print media lying adjacent to it. This area is illustrated by the circle referenced $i_1$ In the figure. This imaging step in the present embodiment is carried out while the print media is stationary, prior to a media feed step. However, in other embodiments, the print media may be moving. As the media feed operation commences, the controller monitors the position of the media, i.e. the instantaneous degree to which the media has been advanced, using a conventional shaft encoder associated with the drive roller 118 that is used to advance the media. The controller then controls the sensing element 304*a* to image a further area of the media, as it passes adjacent the sensing element 304*a*. This further area of media is illustrated by the circle referenced $i_2$ in the figure. As can be seen from the figure, the area of media $i_2$ is located a distance of "x" upstream from the area of media $i_1$. In the present embodiment, the distance "x" is less than the distance "d" separating the sensing elements 304*a* and 304*b* in the media feed direction.

As the media advance continues, the area of media $i_1$ passes adjacent to the sensing element 304*b*. This occurs when the media has been advanced a distance corresponding to the distance "d" separating the sensing element 304*a* and 304*b*. The controller detects this moment in time, again using the output of the drive roller shaft encoder. The controller then controls the sensing element 304*b* to image the area of media $i_1$ to determine the exact position of the area of media $i_1$ relative to the position of the sensing element 304*b*. The image of the area $i_1$ of media taken by the sensing element 304*b* can then be compared with that taken by the sensing element 304*a*. In this manner, the distance that the print media has been advanced so far in the media feed operation may be calculated in a manner that is more accurate than may be achieved using the shaft encoder associated with the drive roller 118 in isolation. In this manner, the distance that the media has been fed in the media feed direction may be accurately established. It will be understood that this distance may be exactly the distance "d". Alternatively, this given distance may be the distance "d", plus or minus an error distance. Once the given distance has been established, the controller monitors the output of the shaft encoder associated with the drive roller 118, to determine when the media has advanced a further distance "x"; equal to the separation between areas of media $i_1$ and $i_2$.

When it is determined that the media has advanced a further distance "x", the area $i_2$ is located substantially adjacent to the sensing element 304*b*. The controller then controls the sensing element 304*b* to image this area; referenced $i_2'$ in the figure. In the figure, the areas corresponding to the areas imaged by the sensing element 304*b* are illustrated as dashed circles. They are referenced $i_1'$ and $i_2'$. In the figure, both of the areas $i_1'$ and $i_2'$ are shown in the figure in the positions that they occupy relative to the two sensing elements 304*a* and 304*b*, when the area $i_2/i_2'$ is located substantially adjacent to the sensing element 304*b*. In the present embodiment, the borders of the areas imaged by the sensing element 304*b* will be nearly, if not exactly, coterminous with the corresponding areas imaged by the sensing element 304*a*. Thus, for the purposes of clarity, only the areas $i_1'$ and $i_2'$ are referenced in the figure downstream of the sensing element 304*a*.

In this manner, it may be it may be accurately established when the media has been fed a distance of "d+x" in the media feed direction. In the present embodiment, the distance "d+x" is made equal to the distance $f_i$; where $f_1$ is equal to the total distance that the media is advanced in the media advance phases "a", "b" and "c", illustrated in FIG. 4. Since the distance "d", which separates the two sensing elements 304*a* and 304*b* is generally fixed, it will be appreciated that that for any distance $f_1$ which is greater than "d", the distance "x" may be selected by the controller such that the distance "d+x" is made equal to the distance $f_1$.

It will be understood that the remaining portions of the media advance operation are the low velocity media advance phase "d" and the final deceleration phase "e", shown in FIG. 4. These phases correspond to the distance "y" shown in FIG. 5*a*. In practice, this distance may be very short, as it need only be sufficiently long to allow errors in the measured distance "d+x", which will normally be very small, to be corrected for. Thus, the controller may then control the advance of the print media by the distance "y", plus or minus any necessary error correction. Again the output of the shaft encoder associated with the drive roller 118 is used to measure this distance "y". At this point, the media will have advanced a whole media feed distance $f_0$ downstream and the new position of the border p will be that of the line p".

By, utilizing two separate sensing elements, as opposed to a single (larger) sensing element, various advantages may be realized. For a pair of sensing elements that cover a given distance (or have a given separation distance) the size of the images generated will be generally smaller. This in turn means that the portions of the media that is to be imaged may be relatively easily and inexpensively illuminated. Additionally, suitable optics for focusing the images may be easily and inexpensively provided. Furthermore, the resulting system may have reduced memory and processing requirements compared to an equivalent single sensor system. Viewed differently, this means that a system may be able to operate faster, for example in terms of image processing speed, using a pair of sensing elements than would be the case with an equivalent single sensor system.

It will however be appreciated by the skilled reader that the system of the present invention may employ any reasonable hardware and software. Thus, the image processing implemented in embodiments of the present inventions may operate at any reasonable desired speed. In the present example, the final phases of the media advance, the low velocity phase "d" and the final deceleration "e", shown in FIG. 4, are made after the point at which the sensing element 304*b* images area $i_2'$, in order that features imaged by the sensing element 304*a* in area $i_2$ may be recognised. In this manner, at least part of the image processing required to do this may occur during the media feed phase "d" and/or the final deceleration "e". This allows the use of relatively low powered and thus inexpensive imaging processing hardware and/or techniques. However, it will be understood that the length of the media feed phase "d" and/or the final deceleration phase "e" may be reduced by the use of faster image processing. Indeed, if the image processing were sufficiently fast, the media feed phase "d" could be avoided altogether. In this manner, the final deceleration phase "e" could continue directly on from the deceleration phase "c", shown in FIG. 4. In this way, the media advance could be stopped when a suitably positioned feature of the print media is recognized in the area $i_2'$ imaged by the sensing element 304*b*. In such a case, the relative spacing between the areas the areas $i_1$ and $i_2$ imaged by the sensing element 304*a*, and illustrated in FIG. 5*a*, may be adjusted to take this into account.

As has been stated above, different print modes will require that the media is fed a different distance in each media feed operation. Generally, in a scanning inkjet printer, for example, the media is fed four times as far in each media advance in a single pass print mode as is the case in a four pass print mode and eight times as far as is the case in an eight pass print mode. Thus, in an image-forming device that can operate in various print modes, media feed distances of various distances need to be performed. It will be appreciated from the above description that by imaging, or sampling, the media at distance intervals of less than the distance between the sensing elements, a given pair of sensing elements may be effectively used to measure a media advance of any given distance that is greater than the distance between the sensing elements. Thus, by setting the distance "d" separating the sensing elements 304*a* and 304*b* in the media feed direction to a distance which is less than or equal to the minimum media advance distance that the image-forming device is arranged to implement, that distance may be measured according, as described above with reference to FIG. 5*a*.

Figure 5B:
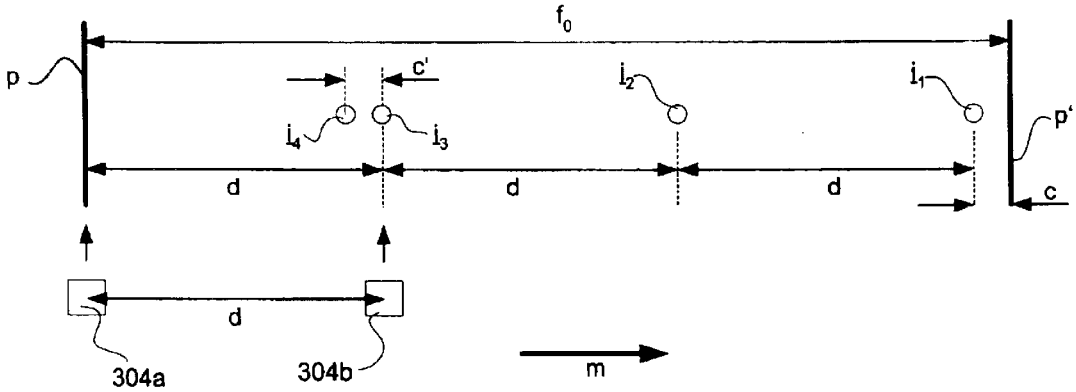

Referring now to FIG. 5*b*, the operation of a media feed process according to an embodiment of the invention will now be described with reference to a print mode that employs a media advance having a media feed distance that is significantly longer than the distance "d" separating the sensing elements 304*a* and 304*b*.

FIG. 5*b* illustrates one media advance of distance $f_0$, where a border on the print media, represented by line p is fed to a new position represented by line p'. In the figure, the position of the two sensing elements 304*a* is illustrated relative to the lines line p to line p'. Thus, the line p lies centrally in the media feed direction relative to the sensing element 304*a*. As described above, the distance separating the two sensing elements 304*a* and 304*b* in the media feed direction (again indicated by the arrow "m") is the distance "d". As can be seen from the figure, the distance $f_0$, in the present example is more than three times the distance "d" separating the two sensing elements 304*a* and 304*b*.

In this example, the sensing element 304*a* has sequentially imaged several areas of the media as the media has advanced past it. These areas are $i_1$ to $i_4$, where these areas were imaged in order, with $i_1$ being the first area to be imaged and $i_4$ being the last area to be imaged. As can be seen in the figure, the areas $i_1$ and $i_2$ are spaced apart by a distance "d" in the media feed direction, equal to the spacing between the sensor elements 304*a* and 304*b* in the media feed direction. The same distance "d" separates areas $i_2$ and $i_3$ in the media feed direction. However, the distance separating areas $i_3$ and $i_4$ in the media feed direction is the comparatively reduced distance "c".

As was described with reference to the process of FIG. 5*a*, the controller monitors the position of the media in the media feed direction using the shaft encoder associated with the drive roller 118. As each of the areas the areas $i_1$ to $i_4$ pass under the sensing element 304*b*, the controller controls the sensing element 304*b* to image these areas. As was described above, the images of these areas taken by the sensing element 304*b* can be compared with the corresponding image taken by the sensing element 304*a* to determine precisely the instantaneous position of the print media in the media feed direction. In the figure, the area $i_3$ is correctly positioned to be imaged by the sensing element 304*b*. Thus, in the figure the areas $i_1$ to $i_2$ have already been imaged by the sensing element 304*b* and the area $i_4$ has not yet to been imaged by the sensing element 304*b*.

It can be seen from the figure that the area $i_1$ needs to be advanced a distance "c" in order to arrive at the line p', at which position the media will have been advanced a complete media advance distance $f_0$. Similarly, the area $i_4$ needs to be advanced a distance "c'" in order to arrive at the position adjacent to the sensing element 304*b* such that it may be imaged. Thus, when the media is advanced such that the area $i_4$ is correctly positioned to be imaged by the sensing element 304*b*, the position of the area $i_4$, relative to the line p' is precisely known, since the distance separating the areas $i_1$ and $i_4$, (2*d*+c), is also precisely known. As has been described above, the embodiment may by arranged such that the media feed operation is stopped once an appropriate feature of the print media, located in area $i_4$, is identified in a corresponding location in the image taken by the sensing element 304*b*. In this case, the distance "c" and "c'" may be set to be almost or exactly the same. Alternatively, the distance "c'" may be set to be somewhat less than the distance "c". In this case, the controller may calculate that the media must be fed by a certain distance further (corresponding to the distance "y" shown in FIG. 4) in order to complete the feed cycle. This calculation may be made once an appropriate feature of the print media, located in the image of area $i_4$ taken by the sensing element 304*a*, is identified in a corresponding image taken by the sensing element 304*b*.

Figure 5C:
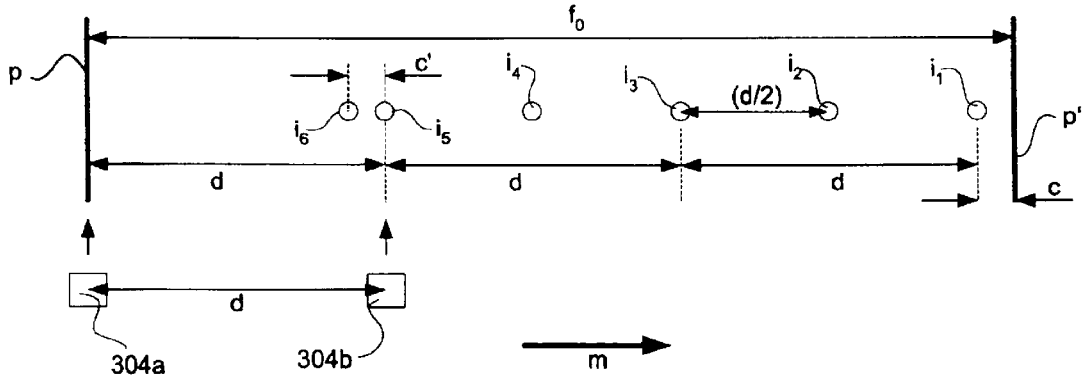

In the process illustrated in FIG. 5*b*, it is apparent that various areas of the print media (in this example 4 areas) are imaged by the sensing elements in a distance in the media feed direction that is less than or equal to one media advance distance $f_0$. It will be appreciated that in practice, the number of areas may be reduced to two or three. However, by imaging more areas the accuracy with which the system measures the media feed may be increased. As will be well understood by the skilled reader, by generating a "population" of feed measurements, or distances, in a given media advance, the measured error for the advance distance (which although it may already be small) may on average be further reduced. If for example, the average measurement error using the system of an embodiment of the invention was 1 micron, by taking four measurements, the statistical error for the population of measurements on average may be (1/(sqrt (4)). Thus, it will be understood that the number of images taken in any given feed operation may be beneficially increased. This is illustrated in FIG. 5*c*. FIG. 5*c* is a diagram that closely resembles FIG. 5*b*, so it will not be described in detail. However, as can be seen from FIG. 5*b*, the number of imaged areas has been increased from four to six in the same media advance distance, generally by spacing the imaged areas closer together in the media feed direction. Imaging an increased number of areas in this way may be particularly useful when printing in print mode with a high number of passes; for example an eight pass print mode. In such a print mode, the ink dots making up the image in a given location will be composed of dots printed in up to eight passes, where the print media was positioned in a different position relative to the print heads and the sensing elements 304 during each of the eight passes. Thus, in certain situations, improving the accuracy with which the position of the media is known in this manner, may yield superior resultant print quality.

In the example of FIG. 5*c*, the controller controls the sensing elements to image areas of media, in general, every distance "d/2", where "d" is the distance separating the sensing element in the media feed direction; thus, approximately doubling the number of imaged areas. However, it will be appreciated that the exact number of imaged areas may be any suitable number.

In the examples of FIG. 5*b* and FIG. 5*c*, the spacing between the most of the adjacent areas is common or fixed (i.e. between adjacent areas $i_1$ to $i_3$ in FIG. 5*b* and between adjacent areas $i_1$ to $i_5$ in FIG. 5*c*). However, in other embodiments of the invention the spacing may be variable. Furthermore, in the examples of FIG. 5*b* and FIG. 5*c* the spacing between the last pair of areas (i.e. between areas $i_3$ and $i_4$ in FIG. 5*b* and between areas $i_5$ and $i_6$ in FIG. 5*c*) is different to the spacing between the other adjacent pairs of areas. It will be understood that in other embodiments of the invention the spacing between last pair of areas may be the same as that separating one or more other pairs of imaged areas.

It is noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

We claim:

1. A media feed measurement system adapted to identify media features on the media per se, at first and second locations spaced apart by a first distance along a media feed path, the system being arranged during a feed operation to identify a first then a second feature, the first location and subsequently to identify those features at the second location, the features being spaced apart along the feed path by a second distance substantially less than the first distance, the system being arranged to determine a given media feed distance in dependence upon the first and the second distance.

2. A system according to claim 1, wherein the first and second features are selected such that when the second feature is identified at the second location, the first feature is substantially located at a predetermined position.

3. A system according to claim 2, the predetermined position corresponds to the end of the feed operation.

4. A system according to claim 2, wherein the predetermined position corresponds to a position a substantially known distance prior to the end of the feed operation.

5. A system according to claim 4, wherein the known distance comprises a fine positional adjustment based on the determination of the system.

6. A system according to claim 5, wherein the system is adapted to identify one or more features at the first position, upstream of the second feature, such that when the one or more features are subsequently identified at the second position, the feed operation including the known distance and fine positional adjustment is completed.

7. A system according to claim 4, wherein the known distance is completed with a media feed operation without feedback.

8. A system according to claim 7, wherein the known distance is measured using an encoder, such as a shaft encoder associated with a media drive roller, wheel or belt.

9. A system according to claim 1, wherein the feed operation is arranged to feed the media between one and two times the length of the first distance.

10. A system according to claim 9, wherein the system is arranged during the feed operation to identify one or more further media features spaced apart from the first and second features along the media feed path at both the first location and subsequently at the second location.

11. A system according to claim 10, wherein the one or more further media features are located on the media downstream of both the first and second features.

12. A system according to claim 10, wherein the first, the second and the one or more further media features are arranged in a series with substantially equal spacing between adjacent features of the series.

13. A system according to claim 10, wherein during the feed operation the media is advanced using a substantially open loop positional control system, the media feed distance being periodically updated with incremental feed distances when the media features are identified in the second location.

14. A system according to claim 13, wherein the system is arranged to generate a statistical population of incremental feed distances and to calculate the average incremental feed distance of the population.

15. A system according to claim 1, wherein the feed operation is arranged to feed the media more that two times the length of the first distance.

16. A system according to claim 1, wherein media feed measurement system is associated with a scanning inkjet printer.

17. A system according to claim 16, wherein the distance by which the media is fed during the feed operation depends upon the print mode used.

18. A system according to claim 17, wherein the feed operation feeds the media by one swath width or a fraction of a swath width.

19. A system according to claim 16, wherein the system comprises first and second optical sensors arranged to generate images of the media.

20. A system according to claim 19, wherein the one or more sensors are located in a media supporting surface, such as a platen, of the printer.

21. A system according to claim 19, wherein the one or more sensors are adapted to capture images of inherent physical aspects of the media.

22. A system according to claim 21, further comprising a processor device adapted to identify one or more features in images of the media and to determine whether the one or more features identified in one image correspond to the one or more features identified in the other image.

23. A system according to claim 1, wherein the media features are located on an underside surface of the media which is opposite to a front surface on which printing is printable.

24. A method of measuring the advance of print media along a media feed path of a copy device, the copy device being adapted to identify media features on the media per se at first and second locations spaced apart by a first distance along the media path, comprising the steps of;

identifying at the first location a first then a second feature, spaced apart along the feed path by a second distance substantially less than the first distance;

subsequently identifying those features at the second location; and determining a given media feed distance in dependence upon the first and the second distance.

25. A method according to claim 24, further comprising the step of determining the second distance such that when the second feature is identified at the second location, the first feature is substantially located at predetermined position.

26. A method according to claim 25, wherein the predetermined position corresponds to the end of the feed operation.

27. A method according to claim 24, comprising the further step of feeding the media a fine adjustment distance, in dependence upon the step of determining.

28. A computer program comprising program code means for performing the method step of claim 24, when the program is run on a computer and/or other processing means associated with suitable apparatus.

29. A method according to claim 24, wherein the identification of media features identifies media features on an underside surface of the media which is opposite to a front surface on which printing is printable.

* * * * *

UNITED STATES PATENT AND TRADEMARK OFFICE

CERTIFICATE OF CORRECTION

PATENT NO. : 6,929,342 B2
APPLICATION NO. : 10/629639
DATED : August 16, 2005
INVENTOR(S) : David Claramunt et al.

It is certified that error appears in the above-identified patent and that said Letters Patent is hereby corrected as shown below:

Col. 9, line 64, after "feature" delete "," and replace it with --at--.

Signed and Sealed this

Eighth Day of May, 2007

JON W. DUDAS
*Director of the United States Patent and Trademark Office*